US009884222B2

(12) United States Patent
Chen

(10) Patent No.: US 9,884,222 B2
(45) Date of Patent: Feb. 6, 2018

(54) MULTIFUNCTIONAL TREADMILL

(71) Applicant: JIH KAO ENTERPRISE CO., LTD., Taipei (TW)

(72) Inventor: Hung-Tu Chen, Taipei (TW)

(73) Assignee: JIH KAO ENTERPRISE CO., LTD., Taipei (TW)

( * ) Notice: Subject to any disclaimer, the term of this patent is extended or adjusted under 35 U.S.C. 154(b) by 67 days.

(21) Appl. No.: 14/993,772

(22) Filed: Jan. 12, 2016

(65) Prior Publication Data

US 2017/0120102 A1 May 4, 2017

(30) Foreign Application Priority Data

Oct. 29, 2015 (TW) ..... 104217337 U

(51) Int. Cl.
*A63B 24/00* (2006.01)
*A63B 22/02* (2006.01)

(52) U.S. Cl.
CPC ..... *A63B 22/02* (2013.01); *A63B 24/0087* (2013.01)

(58) Field of Classification Search
CPC . A63B 71/0622; A63B 22/00; A63B 22/0002; A63B 22/02; A63B 24/00; A63B 24/0062; A63B 24/0087
See application file for complete search history.

(56) References Cited

U.S. PATENT DOCUMENTS 7,618,345 B2 * 11/2009 Corbalis ..... A63B 22/00 482/1
8,409,059 B2 * 4/2013 Moon ..... A63B 22/0002 482/1
2013/0190136 A1 * 7/2013 Watterson ..... A63B 71/0622 482/8
2015/0182783 A1 * 7/2015 Cutler ..... A63B 22/02 482/54

* cited by examiner

*Primary Examiner* — Glenn Richman
(74) *Attorney, Agent, or Firm* — McCoy Russell LLP

(57) ABSTRACT

A multifunctional treadmill is provided with a platform on the running deck. A reception cavity is formed on a top of the platform, the reception cavity has a sensor and an operating board tiltably mounted on one side of the reception cavity. When the operating board is released for the reception cavity, the treadmill is in a standard speed mode. When the user wants to exercise and work or do other activities at the same time, the user can store the operating board into the reception cavity so that the operating board and a top surface of the platform become a workbench. Simultaneously, the sensor is triggered and the treadmill changes to a low speed mode. Thus, the safety may be improved by forcefully restricting the speed of the running deck.

12 Claims, 6 Drawing Sheets

MULTIFUNCTIONAL TREADMILL

CROSS-REFERENCE TO RELATED APPLICATIONS

This application is based upon and claims priority under 35 U.S.C. 119 from Taiwan Patent Application No. 104217337 filed on Oct. 29, 2015, which is hereby specifically incorporated herein by this reference thereto.

BACKGROUND OF THE INVENTION

1. Field of the Invention

The present invention relates to a treadmill.

2. Description of the Prior Arts

Various exercise habits are more and more common with the gradually rising awareness of health care in recent years. Especially, jogging can be done without special skills but is still a good means for training cardiopulmonary function, so jogging has been one of the most effective sports for improving health. However, one of the big problems of jogging is that jogging cannot be done when the weather is bad. Thus, in order to jog indoors, using a treadmill becomes more and more popular.

On the other hand, sitting for a long time without moving is really harmful to health. Even though everyone has some sort of exercise habit regularly, it is hard to avoid keeping in the sedentary posture when working, and it reduces the effect of exercise. Besides, during the leisure time, people always remain seated when watching TV, reading books, or using the computer, tablet and cell phone, all of which are detrimental to health as well. Furthermore, as working overtime has become a commonplace, people seldom have time to exercise after work. Even having a treadmill at home, many people do not have many chances to run on it.

To overcome the shortcomings, the present invention provides a multifunctional treadmill to mitigate or obviate the aforementioned problems.

SUMMARY OF THE INVENTION

The main objective of the present invention is to provide a multifunctional treadmill that allows the user to use the computer or tablet or read when jogging on the treadmill.

The multifunctional treadmill has a running deck;

two support rods mounted on two sides of the running deck respectively and protruding upward;

a platform mounted on the two support rods and including a reception cavity formed on a top surface of the platform; and a sensor disposed in the reception cavity;

an operating board tiltably mounted on the platform, and including a tilting axis defined on a side of the reception cavity, and an orientation of the tilting axis is perpendicular with an orientation of the running deck;

wherein the operating board is capable of being received in the reception cavity; when the operating board is received in the reception cavity, the operating board triggers the sensor and makes the multifunctional treadmill into a low speed mode; when the operating board is released from the reception cavity, the multifunctional treadmill is in a standard speed mode.

Consequently, the advantage of the aforementioned treadmill is that the operating board is capable of being received in the reception cavity of the platform. A rear surface of the operating board and the top surface of the platform form a plane, allowing the top surface of the platform available for placing a tablet electronic device or a laptop. In addition, after the sensor detects that the operating board is received in the platform, the treadmill changes to the low speed mode from the standard speed mode. Thus, the treadmill provides enforced safety, so that the treadmill prevents the user from increasing the speed of the treadmill when operating the tablet electronic device or laptop and avoids danger.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
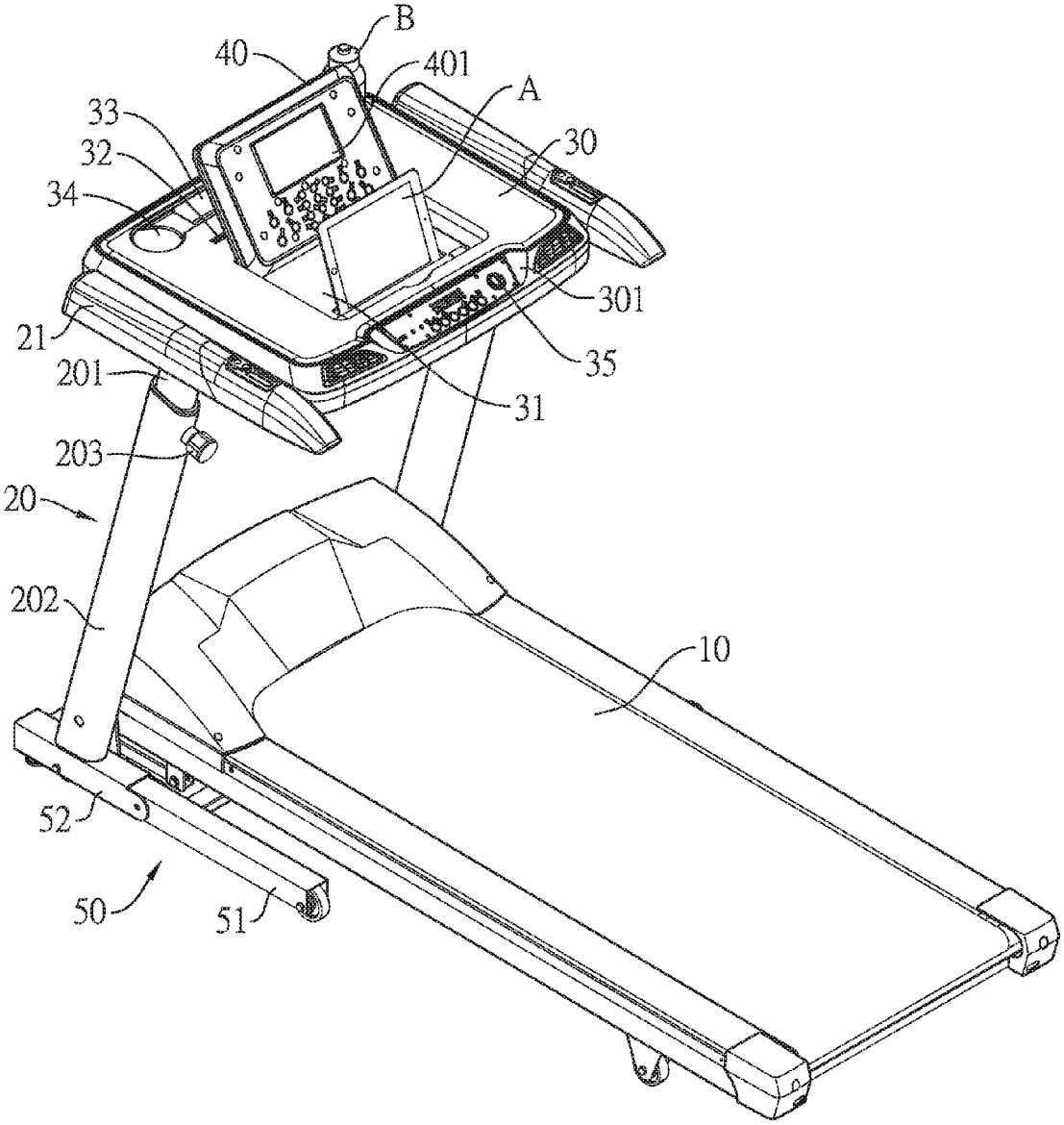
FIG. 1 is a perspective view of a multifunctional treadmill in accordance with the present invention, showing that an operating board is released.

With reference to FIG. 1, a multifunctional treadmill in accordance with the present invention comprises a running deck 10, two support rods 20, a platform 30, an operating board 40 and a base 50.

The support rods 20 are mounted on two sides of the running deck 10 respectively and extend upward. The platform 30 is mounted on the support rods 20 and includes a reception cavity 31 formed in a top surface of the platform 30. The reception cavity 31 includes a sensor 311. The platform 30 also includes a low speed mode operating interface 301 disposed on a margin which is adjacent to the user. The user is able to operate the treadmill and read information of the treadmill or physical functions through the low speed mode operating interface 301.

Figure 2:
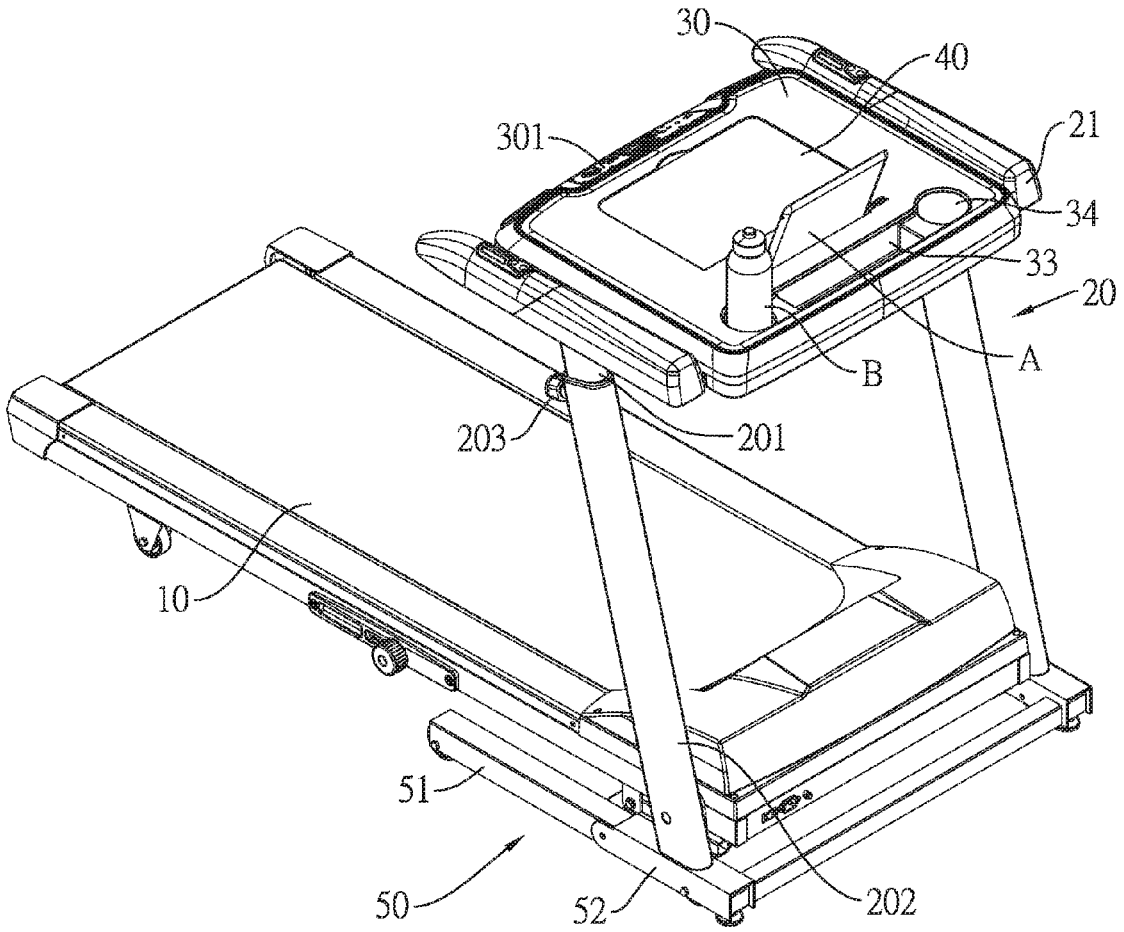
FIG. 2 is a perspective view of the multifunctional treadmill in FIG. 1, showing that the operating board is received for storage.
Figure 3:
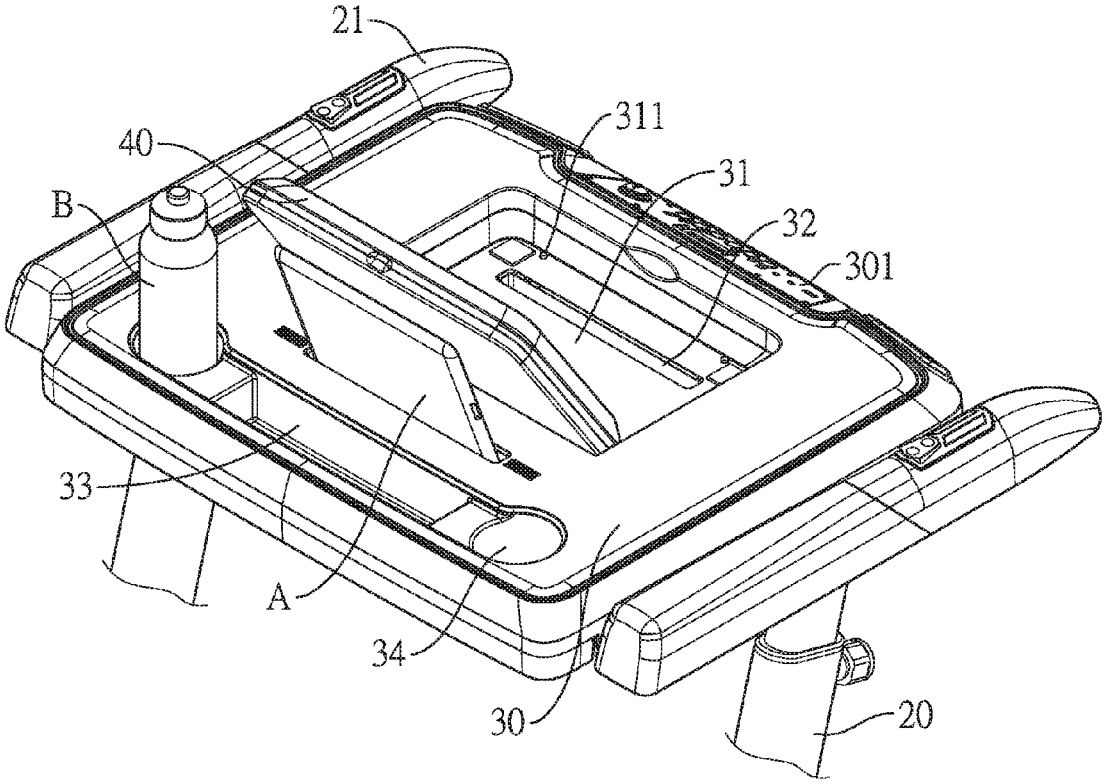
FIG. 3 is a perspective view of the multifunctional treadmill in FIG. 1, showing a reception cavity and a sensor.

Then refer to both FIGS. 2 and 3. The operating board 40 is tiltably mounted on the platform 30 and is capable of pivoting about a tilting axis defined on a side of the reception cavity 31, and thereby the user can tilt and store the operating board 40 into the platform 30. An orientation of the tilting axis is perpendicular with an orientation of the running deck 10.

A front surface of the operating board 40 includes an operating interface, i.e. a standard speed mode operating interface 401. When the operating board 40 is released from the reception cavity 31 and exposes the standard speed mode operating interface 401, the user is able to operate the treadmill and read information of the treadmill or physical functions through the standard speed mode operating interface 401. At this moment, the treadmill is in a standard speed mode and the maximum speed limit of the treadmill is, like a conventional treadmill, 18 KPH or 22 KPH, and the minimum speed limit is close to zero, e.g. 0.8 KPH. The maximum speed limit and the minimum speed limit are in accordance with a safety range of the treadmill.

In order to receive the operating board 40 in the reception cavity 31 (as shown in FIG. 2), the user tilts the standard speed mode operating interface 401 to cover the reception cavity 31 but exposes a rear surface of the operating board 40. At this moment, the rear surface of the operating board 40 aligns with the top surface of the platform 30, and the operating board 40 triggers the sensor 311. The sensor 311 can be a mechanical, electronic, or optical sensor for detecting whether the operating board 40 is received in the reception cavity 31. As shown in FIG. 3, in this embodiment, the sensor 311 is a button. When the operating board 40 is received in the reception cavity 31, the operating board 40 presses the sensor 311, and the treadmill is changed into a low speed mode. At this moment, the maximum speed limit is restricted to a lower speed, e.g. 5 or 6 KPH.

In other words, when the treadmill is in the low speed mode, the top surface of the platform 30 is emptied and available for placing a tablet electronic device A (e.g. a tablet or cell phone), a laptop, a book or documents (the figures illustrate the tablet electronic device A is put on the platform 30, for example). Because the user only can do moderate exercises, such as walking, in the low speed mode of the present treadmill, the laptop operating or book reading may not be interrupted by intense movements. Besides, in the low speed mode, even if the user presses an accelerator button on the low speed mode operating interface 301, the speed of the treadmill will not exceed the maximum speed limit so that the treadmill prevents the danger generated by unintentional touching the accelerator button by the user.

The platform 30 further comprises at least one tablet-electronic-device groove 32, a storage recess 33, at least one cup recess 34, and a safety lock 35.

The at least one tablet-electronic-device groove 32 may be an elongated slot and configured for erecting a tablet electronic device A. An orientation of the tablet-electronic-device groove 32 is perpendicular with the orientation of the running deck 10. The section of the tablet-electronic-device groove 32 may be a rectangle or a trapezoid with a wide top and a narrow base. Thus, when the tablet electronic device A is erected in the tablet-electronic-device groove 32, the tablet electronic device A is slightly oblique and faces to the eyes of the user.

The tablet-electronic-device groove 32 may be formed concavely on a bottom surface of the reception cavity 31 and/or the top surface of the platform 30. Specifically, the tablet-electronic-device groove 32 is formed concavely on the platform 30 and located between the reception cavity 31 and a margin of the platform 30 away from the user.

The storage recess 33 is configured for receiving a remote control or other personal belongings, and the at least one cup recess 34 is configured for holding a bottle B or a cup. The storage recess 33 and the cup recess 34 are located on the margin of the platform 30 away from the user, and thereby the stuff in the storage recess 33 or the cup recess 34 may not obstruct that the user operates the operating interface or the tablet electronic device A on the platform 30.

The safety lock 35 is disposed on the margin adjacent to the user, or specifically, is disposed on the low speed mode operating interface 301. The safety lock may be provided with a safety key (not shown in the figures); the safety key is magnetic and connects with a safety clip. The safety clip optionally clips on the user. When the treadmill is operating, the safety key has to be mounted in the safety lock 35, and thereby prevents children who are playing on the treadmill from turning on the treadmill unintentionally and causing danger. In addition, when the user is too far away from the platform 30, for example, when the user is falling down, the safety clip clipped on the user will pull the safety key out from the safety lock 35 and shut down the treadmill to ensure the user is safe.

Figure 4:
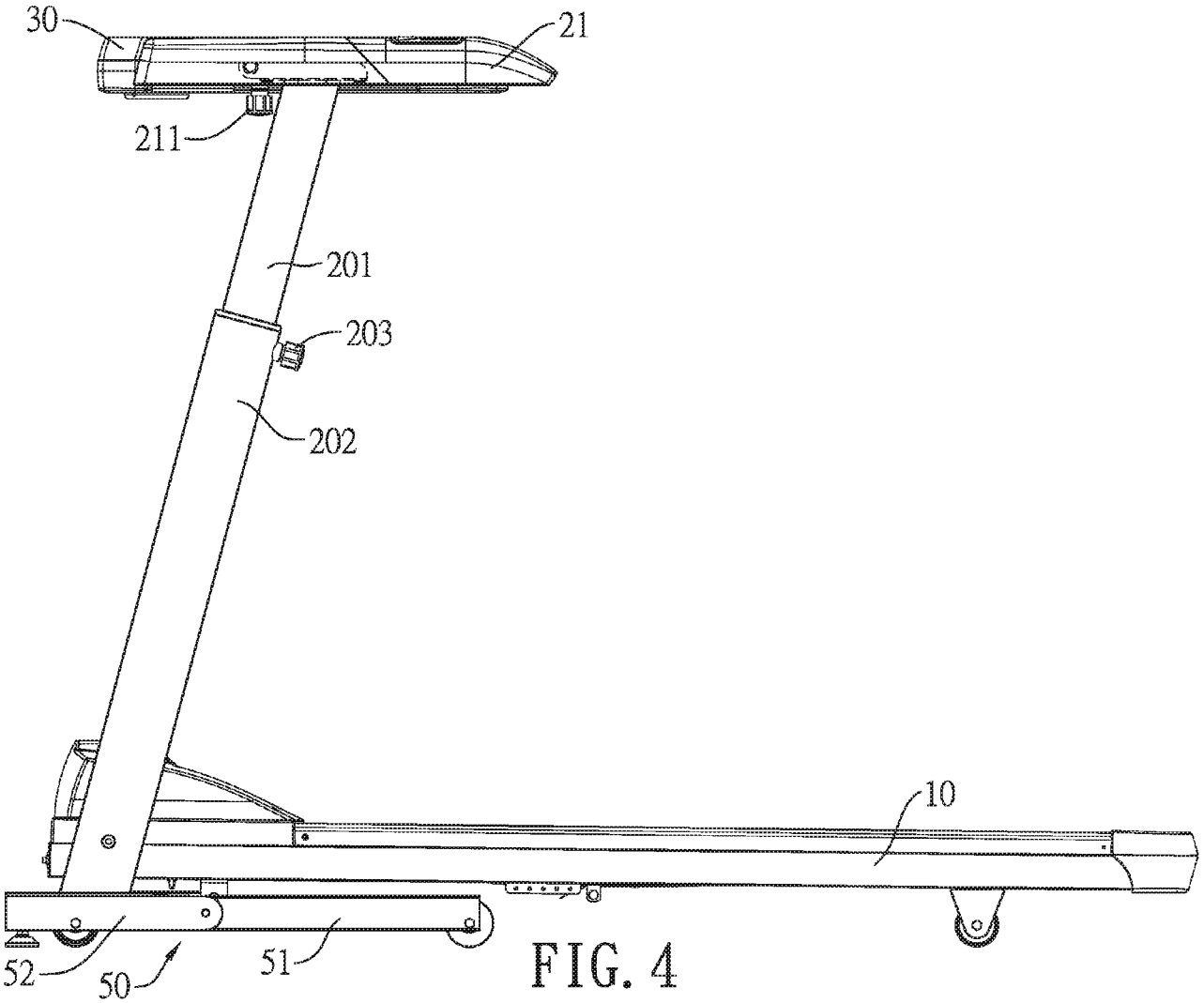
FIG. 4 is a lateral view of the multifunctional treadmill in FIG. 1, showing that the multifunctional treadmill is unfolded.
Figure 5:
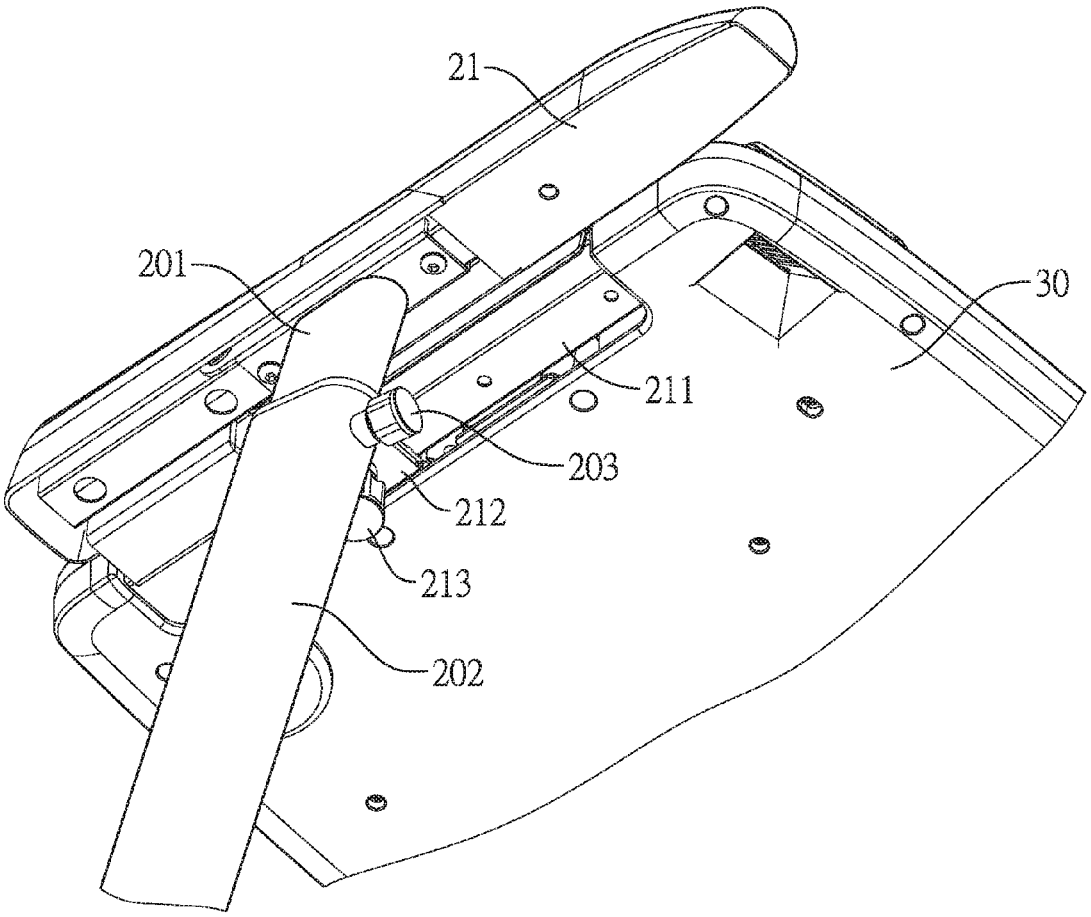
FIG. 5 is a partial perspective view of the multifunctional treadmill in FIG. 1, showing that lower surfaces of the platform and a handle bar.

Then refer to FIGS. 4 and 5. To make the treadmill suitable for different statures or demands of the user, the platform 30 is adjustable in height and distance with respect to the user. Specifically, each one of the support rods is extendable so that the platform 30 can move upward and downward with respect to the running deck 10. In the embodiment, each one of the support rods 20 comprises a first inner tube 201, a first outer tube 202 and a first pin 203. The first inner tube 201 is mounted in the first outer tube 202 and is movable along with the first outer tube 202. The platform 30 is mounted on a top end of the first inner tube 201. The first pin 203 is mounted on a top end of the first outer tube 202. When the first pin 203 is pulled out, the first inner tube 201 can move with respect to the first outer tube 202. When the first pin 203 is inserted, the relative position of the first inner tube 201 and the first outer tube 202 can be determined.

The support rod 20 comprises a pneumatic rod for adjusting the height of the platform 30 easily. Specifically, one end of the pneumatic rod is mounted on the first inner tube 201, and the other end of the pneumatic rod is mounted on the first outer tube 202. Thus, when the pin 203 is pulled out, the pneumatic rod pulls the first inner tube 201 upward with respect to the first outer tube 202.

Besides, a top end of each one of the support rods comprises a handle bar 21. The platform 30 is movably mounted between the handle bars 21. A movement direction of the handle bars 21 is parallel to the running deck 10. The handle bars 21 are located on two sides of the platform 30 and are mounted on the support rod 20 via the platform 30.

In this embodiment, there is a second inner tube 211, a second outer tube 212 and a second pin 213 mounted between the platform 30 and each one of the handle bars 21. The second inner tube 211 is mounted in the second outer tube 212 and is movable along with the second outer tube 212. The second inner tube 211 is fixed on the platform 30 and the second outer tube 212 is fixed on the handle bar 21. The second pin 213 is mounted on a lower side of the second outer tube 212. When the second pin 213 is pulled out, the second inner tube 211 can move with respect to the second outer tube 212. When the second pin 213 is inserted, the relative position of the second inner tube 211 and the second outer tube 212 can be determined.

Figure 6:
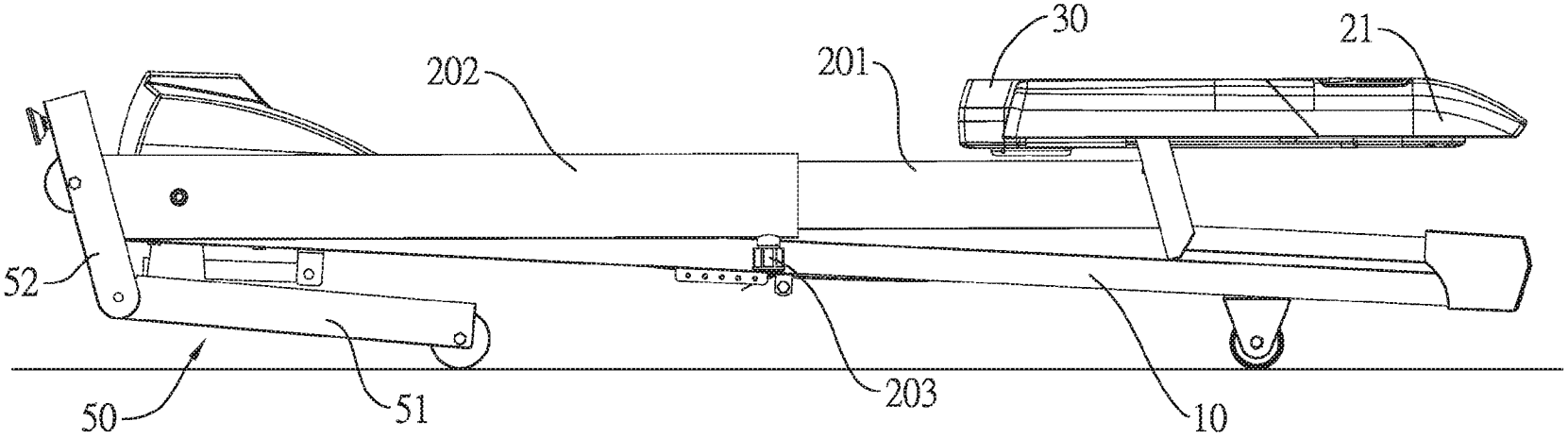
FIG. 6 is a lateral view of the multifunctional treadmill in FIG. 1, showing that the multifunctional treadmill is folded up.

Then refer to FIGS. 4 and 6. To store the treadmill easily when not in use, the present treadmill is foldable. Specifically, the support rods 20 are mounted on the running deck 10 tiltably, and the platform 30 is mounted on the support rods 20 tiltably. The base 50 comprises a fixing portion 51 and a pivoting portion 52. The fixing portion 51 is mounted under the running deck 10 and configured for abutting the ground. The pivot portion 52 is mounted on two bottom ends of the two support rods 20 and is tiltably mounted on the fixing portion 51. The steps of the storage may be tilting the platform 30 to be parallel with the support rods 20 first, and then tilting the support rods 20 and the platform 30 to be parallel with the running deck 10. The pivoting portion 52 will be tilted when the user tilts the support rods 20, so as to lift up and push the support rods 20 toward the running deck 10.

In order to save labor, the present treadmill comprises a driving unit (not shown in the figures). The driving unit is disposed between the base 50 and the support rods 20, or is disposed between the base 50 and the running deck 10. The driving unit includes a pneumatic element or a hydraulic element to provide force or buffer when the user lifts up or puts down the support rod 20 or the running deck 10.

Consequently, the present treadmill not only can be used as a conventional treadmill, but the user can put the laptop or reading material on the platform 30 and the present treadmill changes to the low speed mode from the standard speed mode forcibly, and thereby the user can work or read when exercising on the treadmill. Thus, the present treadmill is capable of improving health and efficiency of time management. The low speed mode provides enforced safety by restricting the maximum speed limit so that the treadmill prevents the danger that user intentionally presses the accelerator button when doing other activities on the treadmill.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A multifunctional treadmill comprising:

a running deck;

two support rods tiltably mounted on two sides of the running deck respectively and protruding upward;

a platform tiltably mounted on the two support rods and comprising:

a reception cavity formed on a top surface of the platform; and a sensor disposed in the reception cavity;

an operating board tiltably mounted on the platform, including a tilting axis defined on a side of the reception cavity, an orientation of the tilting axis being perpendicular with an orientation of the running deck; and a base, comprising:

a fixing portion mounted under the running deck and configured for abutting the ground; and a pivot portion mounted on two bottom ends of the two support rods and tiltably mounted on the fixing portion;

wherein the operating board is capable of being received in the reception cavity; when the operating board is received in the reception cavity, the operating board triggers the sensor and changes the multifunctional treadmill into a low speed mode; when the operating board is released from the reception cavity, the multifunctional treadmill is in a standard speed mode.

2. The multifunctional treadmill as claimed in claim 1, wherein, when the operating board is received in the reception cavity, a rear surface of the operating board aligns with the top surface of the platform.

3. The multifunctional treadmill as claimed in claim 1, wherein each one of the support rods is retractable, and the platform is movable upward or downward with respect to the running deck.

4. The multifunctional treadmill as claimed in claim 2, wherein each one of the support rods is retractable, and the platform is movable upward or downward with respect to the running deck.

5. The multifunctional treadmill as claimed in claim 1 further comprising two handle bars mounted on two tops of the two support rods, respectively, wherein the platform is movably mounted between the handle bars, and wherein movement of the platform is horizontal.

6. The multifunctional treadmill as claimed in claim 4 further comprising two handle bars mounted on two tops of the two support rods, respectively, wherein the platform is movably mounted between the handle bars, and wherein movement of the platform is horizontal.

7. The multifunctional treadmill as claimed in claim 1, wherein the reception cavity includes a tablet-electronic-device groove formed on a bottom surface of the reception cavity, wherein the tablet-electronic-device groove is an elongated slot, and an orientation of the tablet-electronic-device groove is perpendicular to an orientation of the running deck.

8. The multifunctional treadmill as claimed in claim 6, wherein the reception cavity comprises a tablet-electronic-device groove formed on a bottom surface of the reception cavity, wherein the tablet-electronic-device groove is an elongated slot, and an orientation of the tablet-electronic-device groove is perpendicular to an orientation of the running deck.

9. The multifunctional treadmill as claimed in claim 1, wherein the platform includes a tablet-electronic-device groove formed on the top surface of the platform, the tablet-electronic-device groove is an elongated slot, and an orientation of the tablet-electronic-device groove is perpendicular with the orientation of the running deck.

10. The multifunctional treadmill as claimed in claim 8, wherein the platform comprises a tablet-electronic-device groove formed on the top surface of the platform, the tablet-electronic-device groove is an elongated slot, and an orientation of the tablet-electronic-device groove is perpendicular with the orientation of the running deck.

11. The multifunctional treadmill as claimed in claim 1, wherein the platform includes a storage recess formed on the top surface of the platform; and at least one cup recess formed on the top surface of the platform.

12. The multifunctional treadmill as claimed in claim 10, wherein the platform includes a storage recess formed on the top surface of the platform; and at least one cup recess formed on the top surface of the platform.

* * * * *